US008651920B2

(12) United States Patent
Hashish

(10) Patent No.: US 8,651,920 B2
(45) Date of Patent: Feb. 18, 2014

(54) MIXING TUBE FOR A WATERJET SYSTEM

(75) Inventor: Mohamed Hashish, Bellevue, WA (US)

(73) Assignee: Flow International Corporation, Kent, WA (US)

( * ) Notice: Subject to any disclaimer, the term of this patent is extended or adjusted under 35 U.S.C. 154(b) by 1253 days.

(21) Appl. No.: 12/154,313

(22) Filed: May 21, 2008

(65) Prior Publication Data

US 2009/0288532 A1 Nov. 26, 2009

(51) Int. Cl.
*B24C 5/02* (2006.01)

(52) U.S. Cl.
USPC ..... 451/102

(58) Field of Classification Search
USPC ..... 451/102
See application file for complete search history.

(56) References Cited

U.S. PATENT DOCUMENTS

| | | | | |
|---|---|---|---|---|
| 4,222,204 | A * | 9/1980 | Benner | 451/494 |
| 5,144,766 | A * | 9/1992 | Hashish et al. | 451/102 |
| 5,405,083 | A * | 4/1995 | Moses | 239/9 |
| 5,637,036 | A * | 6/1997 | Hepworth | 451/364 |
| 5,643,058 | A | 7/1997 | Erichsen et al. | |
| 5,908,349 | A | 6/1999 | Warehime | |
| 6,000,308 | A | 12/1999 | LaFountain et al. | 83/53 |
| 6,224,474 | B1 * | 5/2001 | Vander Voort | 451/494 |
| 2001/0030241 | A1 * | 10/2001 | Kott et al. | 239/8 |
| 2003/0037650 | A1 | 2/2003 | Knaupp et al. | |
| 2003/0037654 | A1 | 2/2003 | Sciulli et al. | |
| 2004/0107810 | A1 * | 6/2004 | Sciulli et al. | 83/177 |
| 2005/0037700 | A1 * | 2/2005 | Friel | 451/349 |
| 2006/0258266 | A1 * | 11/2006 | Gleicher | 451/11 |
| 2007/0069040 | A1 * | 3/2007 | Lewis et al. | 239/8 |

FOREIGN PATENT DOCUMENTS

| | | | |
|---|---|---|---|
| EP | 0938399 | B1 | 7/2003 |
| JP | 200783366 | A | 4/2007 |
| KR | 1020070103719 | A | 10/2007 |

* cited by examiner

*Primary Examiner* — Maurina Rachuba
(74) *Attorney, Agent, or Firm* — Seed IP Law Group PLLC

(57) ABSTRACT

A waterjet system for generating and delivering fluid jets suitable for processing a workpiece has a cutting head body and a mixing tube. The cutting head body includes a mixing chamber and a bore. The bore is positioned downstream of the mixing chamber, and an abrasive fluid jet from the mixing chamber passes through the mixing tube. The mixing tube has a first coupler adapted to magnetically couple the mixing tube to the cutting head body when the mixing tube is installed. The cutting head body has a second coupler positioned to engage the first coupler of the mixing tube to keep the mixing tube properly positioned during operation of the waterjet system.

46 Claims, 11 Drawing Sheets

MIXING TUBE FOR A WATERJET SYSTEM

BACKGROUND

1. Technical Field

The present invention relates generally to waterjet systems and, in particular, to abrasive waterjet systems having a magnetically retained mixing tube.

2. Description of the Related Art

Conventional waterjet systems are used to process workpieces by pressurizing fluid and then delivering the pressurized fluid against a workpiece. Abrasive waterjet systems produce high-pressure abrasive fluid jets suitable for cutting through hard materials. High-pressure fluid can flow through a jewel orifice in a cutting head assembly to form a high-pressure fluid jet into which abrasive particles are entrained. This entrainment can take place within a chamber of the cutting head assembly. The high-pressure abrasive fluid jet passes through a mixing tube and is discharged from the mixing tube towards the workpiece.

The axis of the mixing tube has to be aligned with the waterjet coming out of the jewel orifice such that the abrasive fluid jet is properly aligned within the mixing tube. Conventional cutting head assemblies include mechanical components (e.g., collets, bushings, wedging devices, or nut assemblies) for installation of the mixing tube. High torques may be applied to these mechanical components which may require manual operation and result in losing accurate positioning of the mixing tube tip. Also, tools may be needed to access and to operate the mechanical components.

Collets are one type of mechanical component for retaining mixing tubes. If the cutting head assembly has a collet, a tapered surface must be precisely machined into the cutting head body to accommodate the collet, further increasing manufacturing costs. It may be difficult to remove the collet because the collet and the cutting head body may lock together, especially when the tapered surfaces of the cutting head body react significant forces (e.g., clamp-up forces). A hammer tapping process may therefore be needed to dislodge and to separate the collet from the cutting head body.

When the fluid jet passes through the mixing tube at a high velocity, the mixing tube, even if made of a highly wear-resistant material, experiences appreciable wear along its interior cylindrical surface surrounding the fluid jet. Accordingly, mixing tubes have to be replaced periodically within a time as short as a half hour, or perhaps as long as 100 hours, depending upon the material forming the mixing tube, as well as other factors, such as the types of entrained abrasive, working pressures, flow rates, etc. Frequent replacement of worn mixing tubes often leads to problems attributable to the way the mixing tube is retained in the cutting head body, resulting in impaired performance of the system.

Corrosion of the cutting head assembly may also impair performance. Components for retaining the mixing tube, for example, are often made of a material susceptible to corrosion, and have to be frequently replaced if exposed to corrosive materials for significant amounts of time. Replacing corroded components often causes damage to other components of the cutting head requiring replacement of non-corroded components. Water is one corrosive material that may lead to rusting of such components. Rust-resistant components, such as collets made entirely of stainless steel, are relatively expensive. Some cutting head assemblies use plastic type collets to lock the mixing tube and also to seal the mixing chamber.

Other types of abrasive waterjet systems include a removable mixing tube incorporated into a cartridge assembly. U.S. Pat. No. 5,144,766 discloses inserting a mixing tube and a jewel orifice into a housing of a cartridge. To replace the mixing tube, the seal disengages a cartridge housing of the cartridge assembly and may therefore result in contamination of the seal and the cartridge housing. This contamination can lead to leakage during operation of the waterjet system.

BRIEF SUMMARY

In some embodiments, a waterjet assembly includes a cutting head body and a mixing tube. The mixing tube includes a first coupler adapted to magnetically couple the mixing tube to the cutting head body.

In other embodiments, an abrasive waterjet assembly comprises a cutting head body and a mixing tube. The cutting head body has a bore. The mixing tube has an upstream portion disposed within the bore and a coupler extending radially beyond an outer diameter of at least a portion of the upstream portion. The coupler is adapted to magnetically engage the cutting head body.

In some embodiments, a mixing tube for a waterjet assembly includes an elongate main body and a first coupler. The elongate main body has an upstream portion defining an inlet, a downstream portion defining an outlet, and a fluid jet passageway extending between the inlet and the outlet. The first coupler is physically coupled to the main body between the upstream and downstream portions of the main body. The first coupler comprises a magnet for magnetically coupling the mixing tube to a cutting head body of a waterjet assembly when the upstream portion is within the cutting head body.

In some embodiments, a method of assembling a waterjet assembly that includes a cutting head body and a mixing tube is provided. The method includes inserting an upstream portion of the mixing tube into a bore of the cutting head body. A magnetic coupler of the mixing tube magnetically engages the cutting head body to couple the mixing tube to the cutting head body.

In some embodiments, a waterjet assembly includes a cutting head body, a mixing tube, and a reader. The mixing tube includes a sensor adapted to output a signal indicative of the existence of the mixing tube within the cutting head body. The reader is adapted and positioned to receive the signal indicative of the existence of the mixing tube that is outputted by the sensor. The signal can also provide identification information about the mixing tube. Additionally or alternatively, the signal from the sensor can be indicative of the position of the mixing tube.

DETAILED DESCRIPTION

The following description relates to systems for generating and delivering fluid jets suitable for cleaning, abrading, cutting, milling, or otherwise processing workpieces. A waterjet system can have a cutting head assembly with a quick release mixing tube. The mixing tube can be conveniently installed and removed without utilizing torquing tools, such as wrenches, that may damage the waterjet system. The mixing tube can be releasably retained in a cutting head body of the cutting head assembly via magnetic attraction. For example, the mixing tube can be biased towards the cutting head body to reduce, limit, or substantially prevent unwanted movement of the mixing tube relative to the cutting head body. One or more magnets can produce magnetic forces that keep the mixing tube retained in the cutting head body. An operator can conveniently pull the mixing tube out of the cutting head body, and another mixing tube can then be installed in the cutting head body. This process can be repeatedly performed to quickly replace worn mixing tubes without causing unwanted damage to the cutting head body.

Unless the context requires otherwise, throughout the specification and claims which follow, the word "comprise" and variations thereof, such as, "comprises" and "comprising" are to be construed in an open, inclusive sense, that is as "including, but not limited to."

Figure 1:
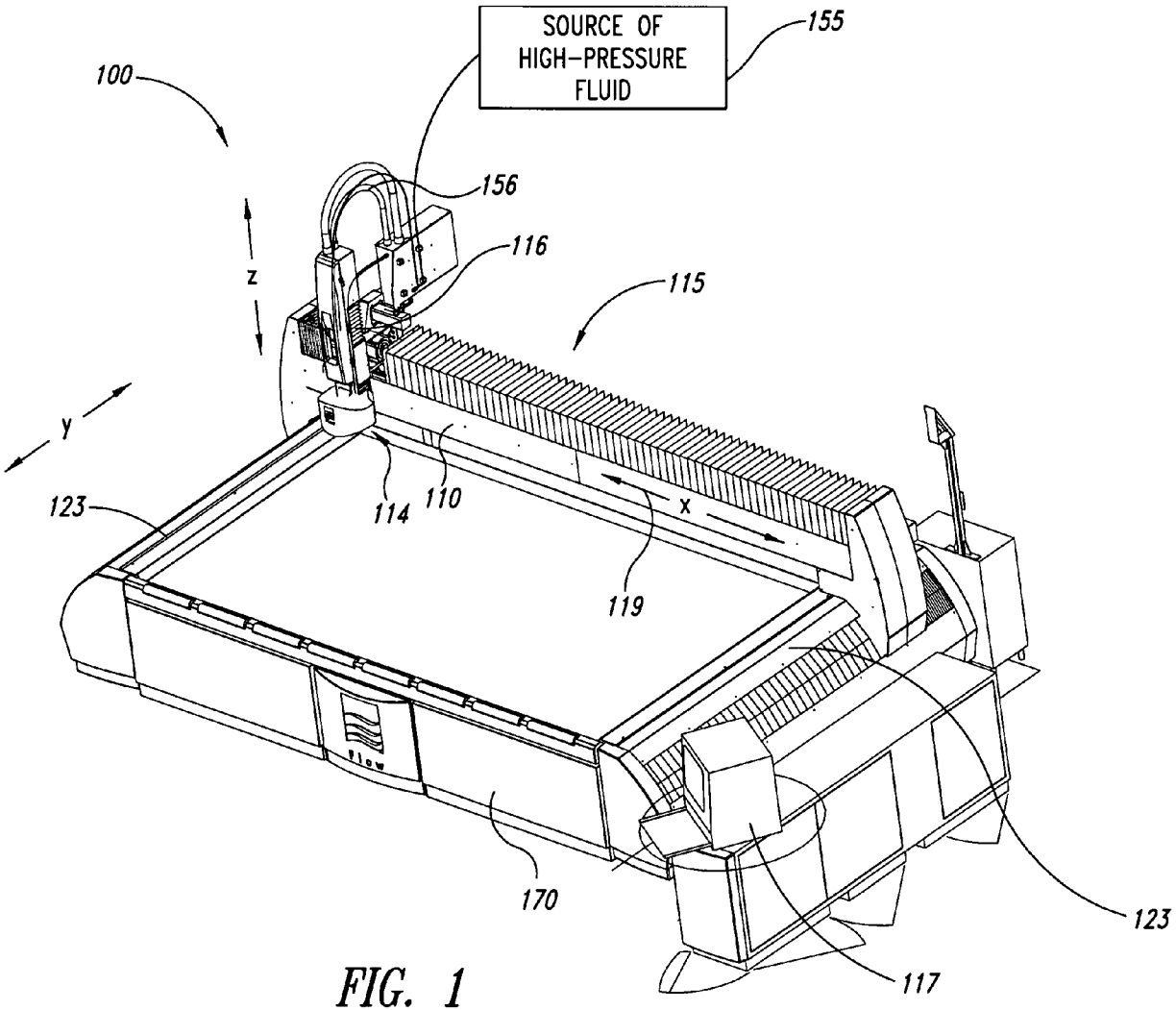
FIG. 1 is an isometric view of a waterjet system, in accordance with one illustrated embodiment.

FIG. 1 shows a waterjet system 100 for processing a wide range of workpieces. The waterjet system 100 includes an end effector assembly 114 moved using an actuation system 115. A control system 117 commands the actuation system 115 to control the path of travel of the end effector assembly 114, capable of generating and delivering a downwardly directed fluid jet (e.g., a waterjet, abrasivejet, and the like) suitable for cleaning, abrading, cutting, milling, or otherwise processing workpieces.

The actuation system 115 of FIG. 1 includes a ram 116 for motion along a vertical Z-axis. The ram 116 is slidably coupled to a bridge 110 for motion along an X-axis that is generally parallel to a longitudinal axis 119 (shown corresponding to the X-axis) of the bridge 110. The bridge 110 is mounted on one or more rails 123 to allow the bridge 110 to move in a direction perpendicular to its longitudinal axis 119. The illustrated bridge 110 can move along a Y-axis that is generally perpendicular to the X-axis. The end effector assembly 114 can be moved along the X-axis, Y-axis, and/or Z-axis using the actuation system 115.

Other types of positioning systems employing one or more linear slides, rail systems, carriages, motors, and the like can be used to selectively move the end effector assembly 114 as needed or desired. U.S. Pat. No. 6,000,308 and U.S. Publication No. 2003/0037650 (Application Ser. No. 09/940,689), which are both herein incorporated by reference in their entireties, disclose systems, assemblies, components, and mechanisms that can be used to move, control, and/or operate the end effector assembly 114.

The control system 117 may generally include, without limitation, one or more controllers, processors, microprocessors, digital signal processors (DSP), application-specific integrated circuits (ASIC), readers, and the like. To store information, controllers may also include one or more storage devices, such as volatile memory, non-volatile memory, read-only memory (ROM), random access memory (RAM), and the like. The storage devices can be coupled to the controllers by one or more busses. The control system 117 of FIG. 1 may further include one or more input devices (e.g., a display, keyboard, touchpad, controller module, or any peripheral device for user input).

The end effector assembly 114 is coupled to a source of pressurized fluid 155 and to a source of abrasive 156. Pressurized fluid from the source of pressurized fluid 155 and abrasive from the source of abrasive 156 are combined in the end effector assembly 114 to generate a fluid jet (e.g., a waterjet comprising only fluid or mixtures of fluids, or an abrasivejet comprising both media, for example, an abrasive, and fluid). The fluid jet is discharged from the end effector assembly 114 towards a workpiece positioned on a table/catcher tank 170 and is manipulated along a selected path, using selected operating parameters, to process the workpiece to achieve a desired end product.

Figure 2:
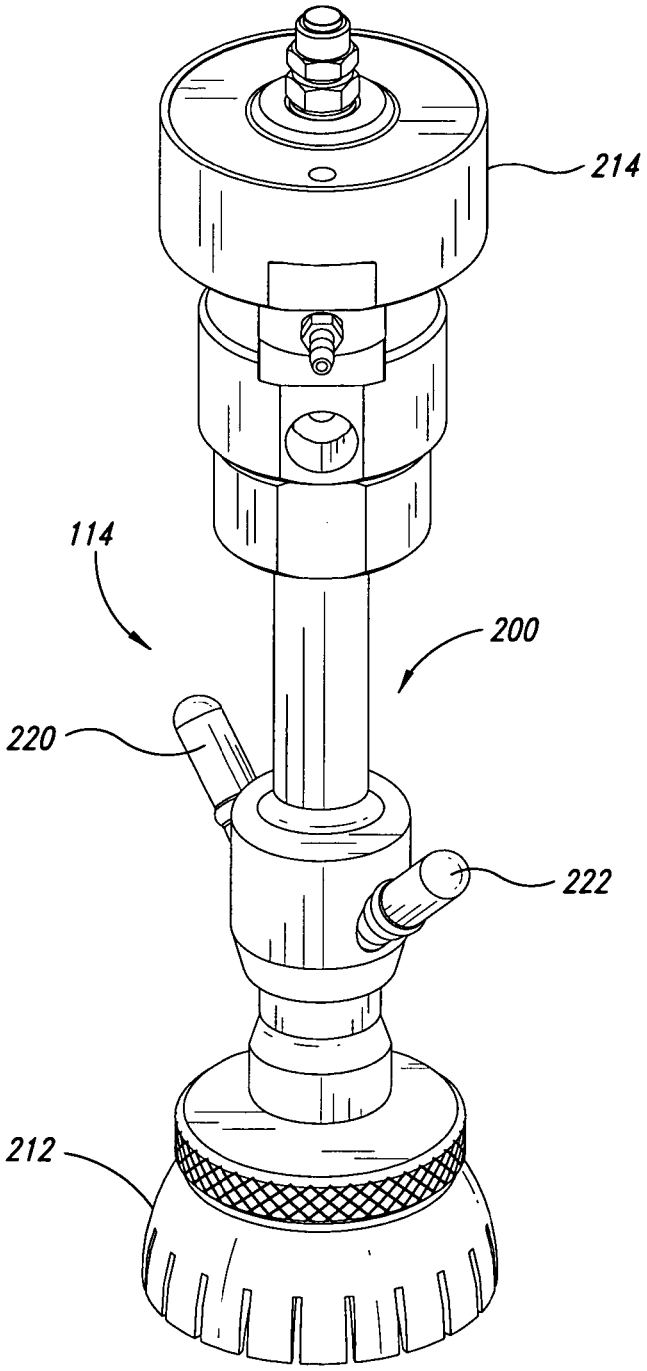
FIG. 2 is an isometric view of an end effector assembly, in accordance with one illustrated embodiment.

Referring to FIG. 2, the end effector assembly 114 includes a valve assembly 214, a cutting head assembly 200, and may include an annular skirt 212 that is temporarily or permanently coupled to the cutting head assembly 200. The cutting head assembly 200 can be for ultrahigh pressures, medium pressures, low pressures, or combinations thereof. Ultrahigh pressure cutting head assemblies can operate at pressures equal to or greater than about 80,000 psi (551 MPa). High-pressure cutting head assemblies can operate at a pressure in the range of about 60,000 psi (413 MPa) to about 90,000 psi (621 MPa). Medium-pressure cutting head assemblies can operate at a pressure in the range of about 15,000 psi (103 MPa) to about 60,000 psi (413 MPa). Medium pressure cutting head assemblies can operate at a pressure of about 40,000 psi (276 MPa). Low-pressure cutting head assemblies can operate at a pressure in the range of about 10,000 psi (69 MPa) to about 40,000 psi (276 MPa).

The components of cutting head assemblies, such as the mixing tube and jewel orifices, can be selected based on the operating parameters, such as working pressures, cutting action, and the like. The illustrated cutting head assembly 200 extends between the valve assembly 214 and the skirt 212. The valve assembly 214 selectively controls the flow of pressurized fluid into the cutting head assembly 200. U.S. Publication No. 2003/0037650, incorporated by reference herein, discloses various types of valve assemblies that can be used with the illustrated cutting head assembly 200. Other types of valve assemblies can also be used with the cutting head assembly 200, if needed or desired.

Pressurized fluid can pass downwardly through the valve assembly 214 and into the cutting head assembly 200. Within the cutting head assembly 200, abrasive may be entrained in the pressurized fluid via a port 220. The illustrated cutting head assembly 200 also includes a second port 222 used to control operation of the end effector assembly 114. The port 222, for example, can allow the introduction of a second fluid and/or media or allow the cutting head assembly 200 to be connected to a pressurization source (e.g., a vacuum source, pump, and the like) or one or more sensors.

Figure 3:
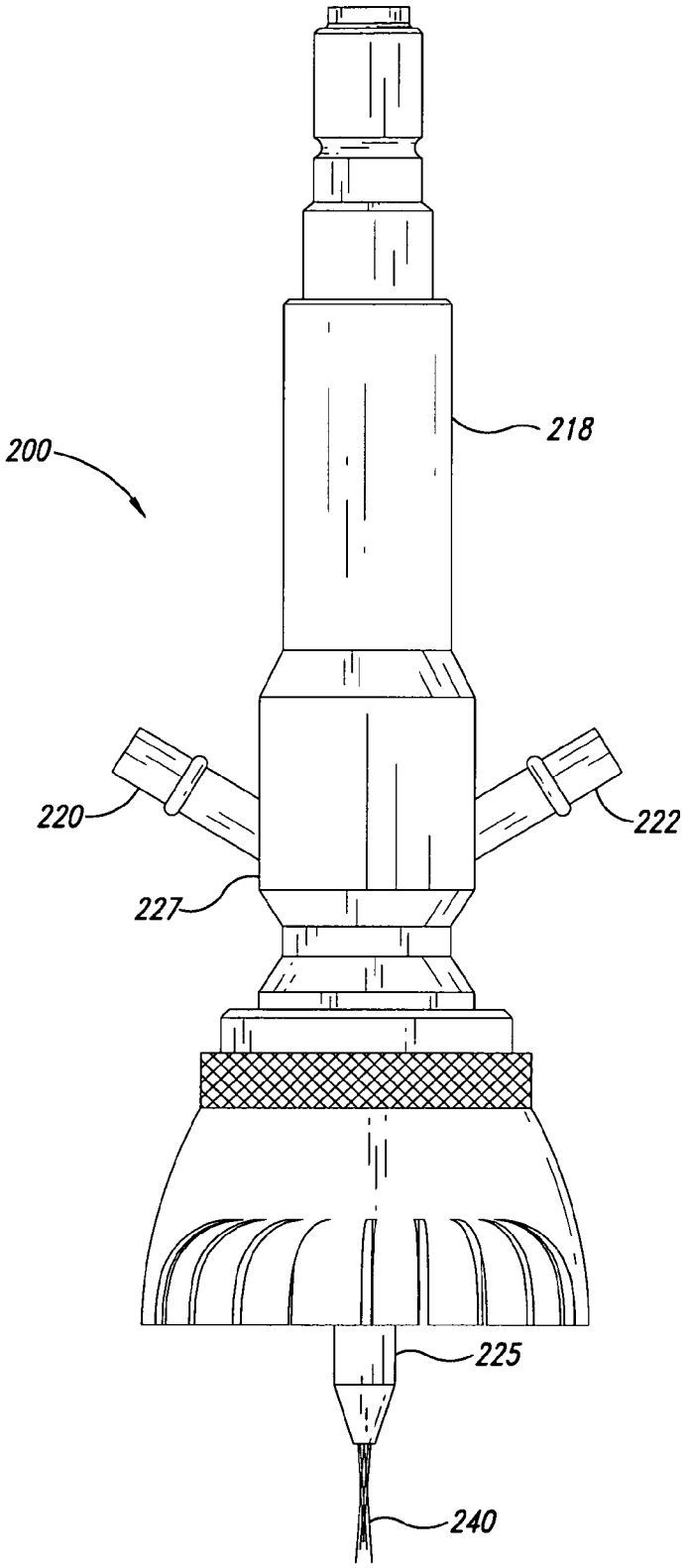
FIG. 3 is a side elevational view of a cutting head assembly having a quick release mixing tube, in accordance with one illustrated embodiment.
Figure 4:
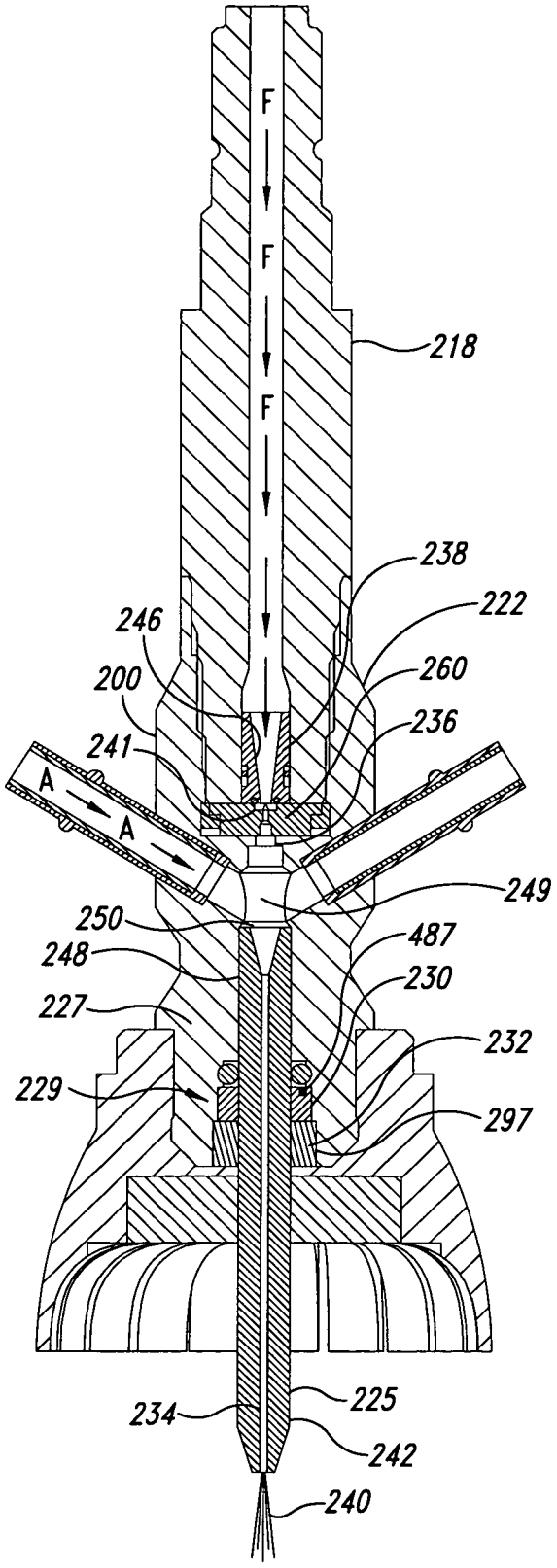
FIG. 4 is a cross-sectional view of the cutting head assembly of FIG. 3.

FIGS. 3 and 4 illustrate the cutting head assembly 200 including a feed conduit 218, a cutting head body 227, and a mixing tube 225 releasably coupled to the cutting head body 227 via a magnetic mixing tube retainer 229. A jet generating assembly 236 for generating a fluid jet includes a seal assembly 238, an orifice mount 260, and a jewel orifice 241 sandwiched between the seal assembly 238 and the orifice mount 260. The illustrated jet generating assembly 236 produces a high pressure fluid jet from the feed fluid F flowing through the feed conduit 218.

The seal assembly 238 of FIG. 4 has a passageway 246 that tapers inwardly in the downstream direction so as to direct the fluid F into and through the jewel orifice 241. The jewel orifice 241 produces a fluid jet in which abrasive A, flowing through the port 220, is entrained at a mixing chamber 249. Various types of jewel orifices or other fluid jet producing devices can be used to achieve the desired flow characteristics of a fluid jet 240. The orifice mount 260 is fixed with respect to the cutting head body 227 and includes a recess dimensioned to receive and to hold the jewel orifice 241. The jewel orifice 241 is thus kept in proper alignment with the passageway 246 of the seal assembly 238 and the mixing tube 225. The configuration and size of the orifice mount 260 can be selected based on the desired position of the jewel orifice 241.

With continued reference to FIG. 4, the mixing tube retainer 229 generates forces sufficient to prevent unwanted separation of the mixing tube 225 and the cutting head body 227. The mixing tube retainer 229 includes a pair of magnetic couplers 230, 232 attracted to each other by forces sufficient to overcome, for example, one or more of a gravitational force acting on the mixing tube 225, forces attributable to a fluid jet 240 flowing along a passageway 234 of the mixing tube 225, and/or other forces experienced during operation. The abrasive fluid jet 240, for example, can interact with a sidewall 242 of the mixing tube 225 defining the passageway 234 to produce significant jet shear forces. The attraction forces can be greater than these shear forces in order to keep the mixing tube 225 in the cutting head body 227.

The mixing tube retainer 229 can reduce, limit, or substantially prevent unwanted movement (e.g., translational movement, rotational movement, or both) of the mixing tube 225. One or both couplers 230, 232 can have magnetic properties for generating magnetic flux. For example, both couplers 230, 232 can be magnets that cooperate to produce large magnetic forces. If only one of the couplers 230, 232 is a magnet, the other coupler 230, 232 can be made, in whole or in part, of a material (e.g., iron, steel, stainless steel, combinations thereof, and the like) that is attracted to magnets.

Figure 5:
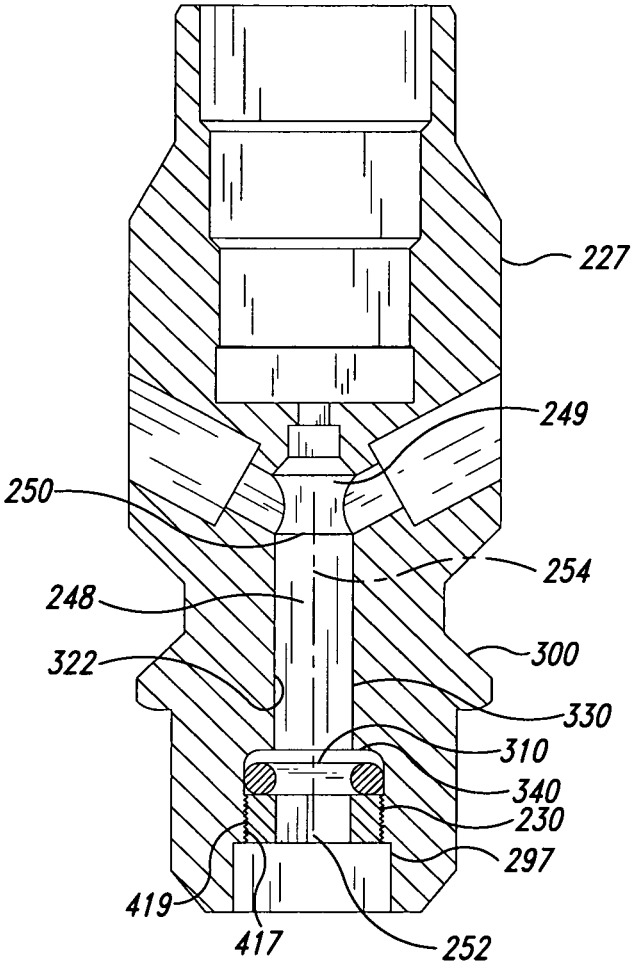
FIG. 5 is a cross-sectional view of a cutting head body of a cutting head assembly, in accordance with one illustrated embodiment.
Figure 6:
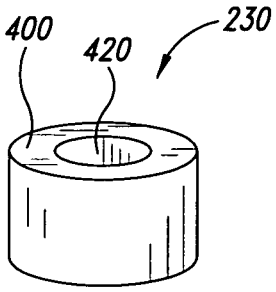
FIG. 6 is an isometric view of a coupler for retaining a mixing, in accordance with one illustrated embodiment.
Figure 7:
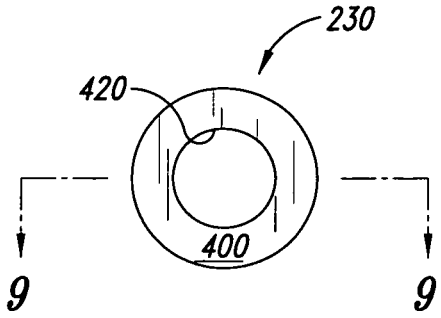
FIG. 7 is a top plan view of the coupler of FIG. 6.
Figure 8:
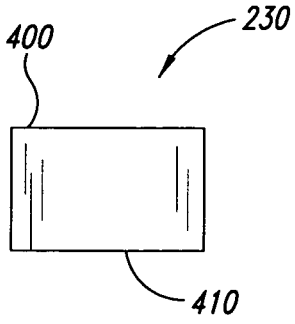
FIG. 8 is a side elevational view of the coupler of FIG. 6.
Figure 9:
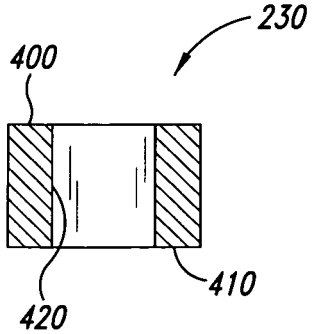
FIG. 9 is a cross-sectional view of the coupler taken along line 9-9 of FIG. 7.

The cutting head body 227 of FIGS. 4 and 5 includes a bore 248 for receiving the mixing tube 225. (FIG. 5 shows the cutting head body 227 with the mixing tube 225 removed.) The bore 248 includes an entrance 250 positioned opposite the jewel orifice 241, an exit 252 defined by the coupler 230 opposite the entrance 250, and a longitudinal axis 254 extending therebetween. The coupler 230 and a sealing member 310 are installed in a unitary housing 300 of the cutting head body 227.

A coupler receiving portion 297 at the bottom of the illustrated unitary housing 300 can receive the coupler 232. The coupler receiving portion 297 faces downwardly for convenient insertion of the coupler 232. The illustrated sealing member 310 is adjacent to and upstream of the coupler 230. The bore 248 is thus defined, at least in part, by a cylindrical downstream section 322 of the housing 300, the sealing member 310, and the coupler 230. To install the mixing tube 225, the mixing tube 225 is inserted through the coupler 230, advanced through the sealing member 310, and then passed through the downstream section 322 until the coupler 232 is properly seated against the coupler 230.

With continued reference to FIG. 5, the entrance 250 to the bore 248 is positioned downstream of the mixing chamber 249. In some embodiments, the entrance 250 is proximate to the location of abrasive entrainment to facilitate entry of the abrasivejet into the mixing tube 225.

The downstream section 322 of the bore 248 can have a uniform or non-uniform axial cross-section that can generally match an axial cross-section of at least a portion of the mixing tube 225. The downstream section 332 can closely surround the mixing tube 225 to reduce, limit, or substantially prevent lateral movement of the mixing tube 225.

The sealing member 310 positioned against a shoulder 340 of the housing 300 can form a fluid tight seal with the mixing tube 225 to reduce, limit, or substantially eliminate fluid escaping between the mixing tube 225 and the housing 300. The illustrated sealing member 310 is a generally annular compressible member (e.g., a rubber or plastic O-ring) surrounding the mixing tube 225. Frictional interaction between the sealing member 310 and the mixing tube 225 can also reduce, limit, or substantially prevent unwanted impact of the couplers 230, 232 that may promote or result in fracture of any of these components. Also, the retainer 229 and sealing member 310 may cooperate to keep the mixing tube 225 in the cutting head body 227. The dimensions and configuration of the sealing member 310 can be selected based on the desired sealing action known in the art.

In some embodiments, the sealing member 310 can also enhance entrainment of the abrasive A, as shown in FIG. 4. For example, the vacuum pressure in the mixing chamber 249 can be selectively increased or decreased to adjust one or more characteristics of the fluid jet 240. The sealing member 310 can seal the mixing chamber 249 from the surrounding environment to maintain the pressure (e.g., a vacuum) in the mixing chamber 249 for facilitating entrainment of the abrasive A.

FIGS. 6-9 show the coupler 230 as a cylindrical member having an upper surface 400, a lower surface 410, and a passageway 420 extending therebetween. The passageway 420 is configured and dimensioned to produce a desired fit with the mixing tube 225, such as a clearance fit. Because the coupler 230 has a simple one-piece construction, it is not prone to malfunction like the complicated moving parts of traditional mechanical retaining systems (e.g., retaining systems having collets, bushings, wedging devices, or nut assemblies), and the coupler 230 is relatively inexpensive to manufacture. Accordingly, the coupler 230 is reliable and has a low manufacturing cost.

The coupler 230 can be removably coupled to the housing 300. If the coupler 230 is removable and the mixing tube 225 of FIG. 4 is replaced with a different type of mixing tube, the coupler 230 may also be replaced to match the new mixing tube. The cutting head body 227 is thus usable with a wide range of different mixing tubes. Fasteners (e.g., nut and bolt assemblies), adhesives (e.g., pressure sensitive adhesives), threads, and the like can removably couple the coupler 230 to the cutting head body 227. In some embodiments, a body of a bolt can extend transversely through the housing 300 and the coupler 230. A nut can be threaded onto a threaded end of the bolt such that the housing 300 is between the nut and a head of the bolt.

In the illustrated embodiment of FIG. 5, the coupler 230 has external threads 417 that mate with complementary internal threads 419 of the cutting head body 227. The coupler 230 can be rotated into and out of the cutting head body 227.

The coupler 230 can also be permanently coupled to or integrated with the housing 300 to, for example, prevent unwanted movement of the coupler 230 relative to the housing 300. Adhesives (including permanent bonding agents), welds, fasteners, and other types of coupling features can fixedly, permanently connect the coupler 230 to the housing 300.

The coupler 230 can include one or more magnets (e.g., electromagnets, permanent magnets, or combinations thereof. The mixing tube 225 can be manually pulled out of the cutting head assembly 227 to overcome any frictional forces between the mixing tube 225 and cutting head assembly 227 and magnetic forces, if any, provided by the coupler 230. Accordingly, the mixing tube 225 can be removed without applying torquing forces or other types of forces necessitating the use of a removal tool. If the coupler 230 is an energizable electromagnet, a current is applied to keep the coupler 230 in a charged state such that the coupler 230 generates a magnetic field suitable for retaining the mixing tube 225. The current can be reduced or stopped to weaken or eliminate the magnetic field to allow removal of the mixing tube 225. The housing 300 can include electrical components for providing power to the coupler 230. Exemplary electrical components include, without limitation, circuitry, wires, and the like and can be embedded in and protected by the housing 300, if needed or desired.

The coupler 230 can be a permanent magnet to reduce power consumption as compared to an electromagnetic coupler and, in some embodiments, may be less susceptible to malfunctions to further reduce machine downtime. Manufacturing costs of the cutting head assembly 200 may also be reduced because there is no need for electrical components in the housing 300.

Figure 10:
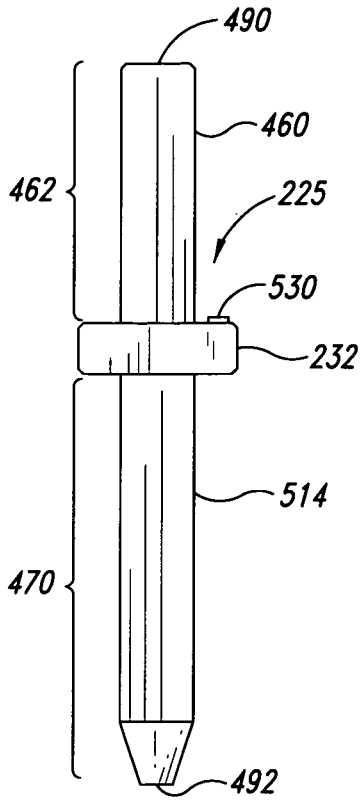
FIG. 10 is a side elevational view of a mixing tube having a coupler, in accordance with one illustrated embodiment.
Figure 11:
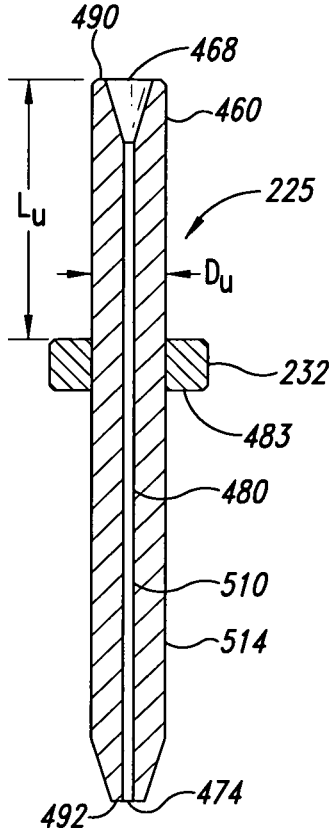
FIG. 11 is a cross-sectional view of the mixing tube of FIG. 10.
Figure 12:
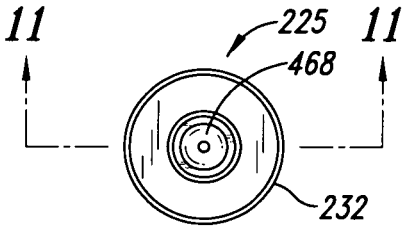
FIG. 12 is a top plan view of the mixing tube of FIG. 10.

Referring to FIGS. 10-12, the mixing tube 225 includes an elongate main body 460 having an upstream portion 462 defining an inlet 468, a downstream portion 470 defining an outlet 474, and a fluid jet passageway 480 extending between and connecting the inlet 468 and the outlet 474. The coupler 232 is physically coupled to the main body 460. In one illustrated embodiment, the coupler 232 of FIGS. 10 and 11 is positioned somewhat midway between opposing ends 490, 492 of the main body 460, but it will be understood that the coupler 232 may be positioned at any other desired location on the mixing tube 225.

The main body 460 can be a continuous tube extending uninterruptedly between the inlet 468 and the outlet 474 and can be a one-piece or multi-piece mixing conduit, focusing conduit, or other type of cylindrical member that produces a desired flow (e.g., a coherent flow in the form of a round jet, etc.). The upstream portion 462 is the section of the main body 460 extending upward from one side of the coupler 232, and the downstream portion 470 is the section of the main body 460 extending downward from the other side of the coupler 232.

In some embodiments, the coupler 232 is adapted to couple the mixing tube 225 to the cutting head body 227 when the upstream portion 462 is received by the cutting head body 227. For example, a substantial portion of the upstream portion 462 may be received by the cutting head body 227. The outer circumference of the upstream portion 462 can be approximately equal to or slightly less than the circumference of the bore 248.

An axial length $L_u$ of the upstream portion 462, clearance between the upstream portion 462 and the cutting head body 227, and axial-cross section of the upstream portion 462 can be selected to increase or decrease the amount of movement of the mixing tube 225 relative to the cutting head body 227. A ratio of the axial length $L_u$ to an average diameter $D_U$ of the upstream portion 462 can be equal to or greater than about 2. Such embodiments are especially well suited for minimal lateral deflections of the mixing tube 225, even if medium-pressure fluid jets are generated. The ratio of the axial length $L_u$ to the diameter $D_U$ of the upstream portion 462 can be equal to or greater than about 1.5, 2, 2.5, or 3 to further reduce movement of the mixing tube 225 for producing high-pressure fluid jets.

The coupler 232 extends radially beyond the outer diameter $D_u$ such that the couplers 230, 232 can be conveniently mated. The coupler 232 of FIGS. 10-12 can be removably coupled to the elongate main body 460, which may experience rapid and significant damage, such as abrasive wearing. After an inner surface 510 defining the passageway 480 is worn a certain amount, the mixing tube 225 can be moved from the cutting head body 227. The coupler 232 is then separated from the main body 460, which is discarded. The coupler 232 is reused to couple another elongate main body to the cutting head body 227. In this manner, the coupler 232 can be used any number of times to couple different elongate main bodies to a single cutting head body. One or more fasteners (e.g., nut and bolt assemblies, set screws, and the like), adhesives (e.g., pressure sensitive adhesives), threads, and the like can temporarily couple the coupler 232 to the main body 460.

Figure 13:
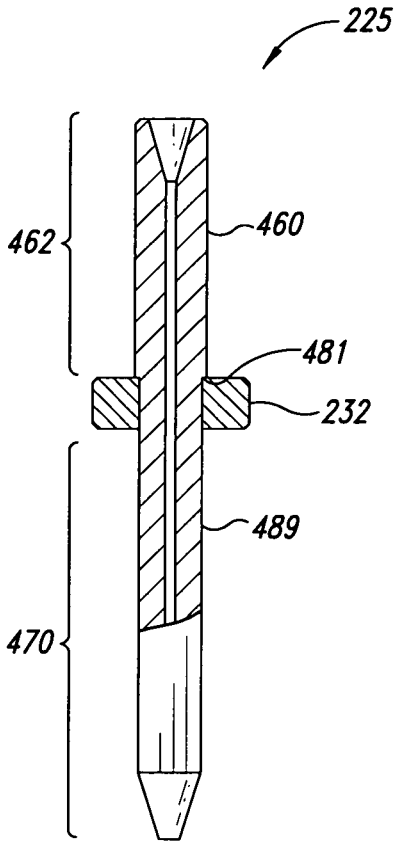
FIG. 13 is a partial cross-sectional view of a mixing tube, in accordance with one illustrated embodiment.

The mixing tube 460 can have at least one fixation feature to position the coupler 232 with respect to the main body 460. FIG. 13 shows the main body 460 that includes a step 481 along the wall of the main body 460. The coupler 232 can slip onto and/or off of the downstream portion 470. The step 481 prevents the coupler 232 from sliding over the upstream portion 462. Other types of fixation features can also be employed.

The coupler 232 of FIGS. 10-13 can also be permanently coupled to the elongate main body 460 to reduce, limit, or substantially eliminate relative movement therebetween. One or more adhesives (including permanent bonding agents), welds, fasteners, and other types of coupling features can permanently and fixedly connect the coupler 232 to the main body 460.

The coupler 232 can be similar to or different than the coupler 230 discussed above. For example, the coupler 232 can include one or more electromagnets, permanent magnets, or combinations thereof. In some embodiments, the coupler 230 is a cylindrical permanent magnet. Additionally or alternatively, the coupler 232 may be formed, in whole or in part, of one or more ferromagnetic materials that are not permanently magnetized. Such coupler 232 can be attracted to the magnetic coupler 230.

Various types of coatings can be applied to components of the cutting head assembly 200 to, for example, enhance performance, prolong service life, facilitate assembling and disassembling, and the like. Exemplary coatings include, without limitation, corrosion resistant coatings (e.g., rust-resistant coatings), release coatings (e.g., coatings made of lubricious materials), electrically insulating coatings, thermally insulating coatings, combinations thereof, and the like.

In some embodiments, at least the upper portion of the coupler 232 and the lower portion 410 of the coupler 230 are coated with a material that serves as a seal and that reduces the attraction impact forces between the couplers 230, 232. Impact resistant coatings can be made of relative compliant materials (e.g., rubber, polymers, and the like) capable of protecting against impact stresses. Also, a rust-resistant coating 483 of the coupler 232 of FIG. 11 can be a thin metal coating (e.g., a rust resistant metal alloy), plastic coating, and/or a polymer coating, as well as other types of coatings that effectively control impact forces, sealing action, and corrosion. Any number of coatings can be applied to components of the mixing tube 225.

One or more sensors may be used to evaluate and/or to identify the mixing tube 225 based on physical contact between the couplers 230, 232, the magnetic field produced by the retainer 229, and the like. The sensors can detect and transmit (or send) a signal indicative of a field or flux (e.g., a magnetic field or flux), pressure, contact, and other measurable physical quantities that can be used to evaluate the performance of the cutting head assembly 200. In some embodiments, the signals provide various types of information about the mixing tube 225. This information can be provided to the operator via a display of the control system 117. The information can include, without limitation, composition of the mixing tube 225, length of the main body 460, diameter of the passageway 480, and other characteristics of the mixing tube 225. In some embodiments, for example, the magnetic coupling provided by the couplers 230, 232 can be measured to determine information about the mixing tube 225 useful in the operation of the cutting head assembly 200.

The mixing tube 225 of FIG. 10, for example, includes a sensor 530 for communicating information about the mixing tube 225. The sensor 530 can be an encodable communication device, such as a radio frequency identification tag that may take the form of radio frequency identification (RFID) circuits, transponders, devices, or tags. To protect the sensor 530, it can be embedded in the coupler 232 or the main body 460.

A reader can communicate with the sensor 530. The term "reader" is broadly construed to include, without limitation, one or more verifiers, interrogators, controllers, read elements, or other devices used to receive information. The coupler 230 of FIG. 4, for example, includes a reader 487 in the form of a radio frequency detector for detecting information encoded in the sensor 530 when the mixing tube 225 is installed. The sensor 530 may have encoded information correlated with physical characteristics of the upstream portion 462 of the mixing tube 225. In other embodiments, the reader 487 is a magnetic flux detector for detecting magnetic flux originating, at least in part, from the coupler 232.

With reference again to FIG. 10, the sensor can also be a proximity sensor that outputs a signal indicative of the position of the mixing tube 250. The term "proximity sensor" includes, but is not limited to, a sensor that detects the spatial relationship (including the presence, distance of separation, and the like) of nearby objects. Exemplary proximity sensors include, without limitation, pressure sensors, contact sensors (including sensors that operate based on physical contact), and position sensors.

In some embodiments, if the couplers 230, 232 become separated a selected distance, the control system 117 can adjust one or more processing parameters (e.g., operating pressures, flow rates of working fluid or abrasives, magnetic field, and the like). For example, if the couplers 230, 232 of FIG. 4 become separated resulting in unwanted positioning of the mixing tube 225, the sensor 530 can send at least one signal to the control system 117, which in turn stops processing of the workpiece. The improperly positioned mixing tube 225 can then be repositioned for subsequent processing.

Figure 14:
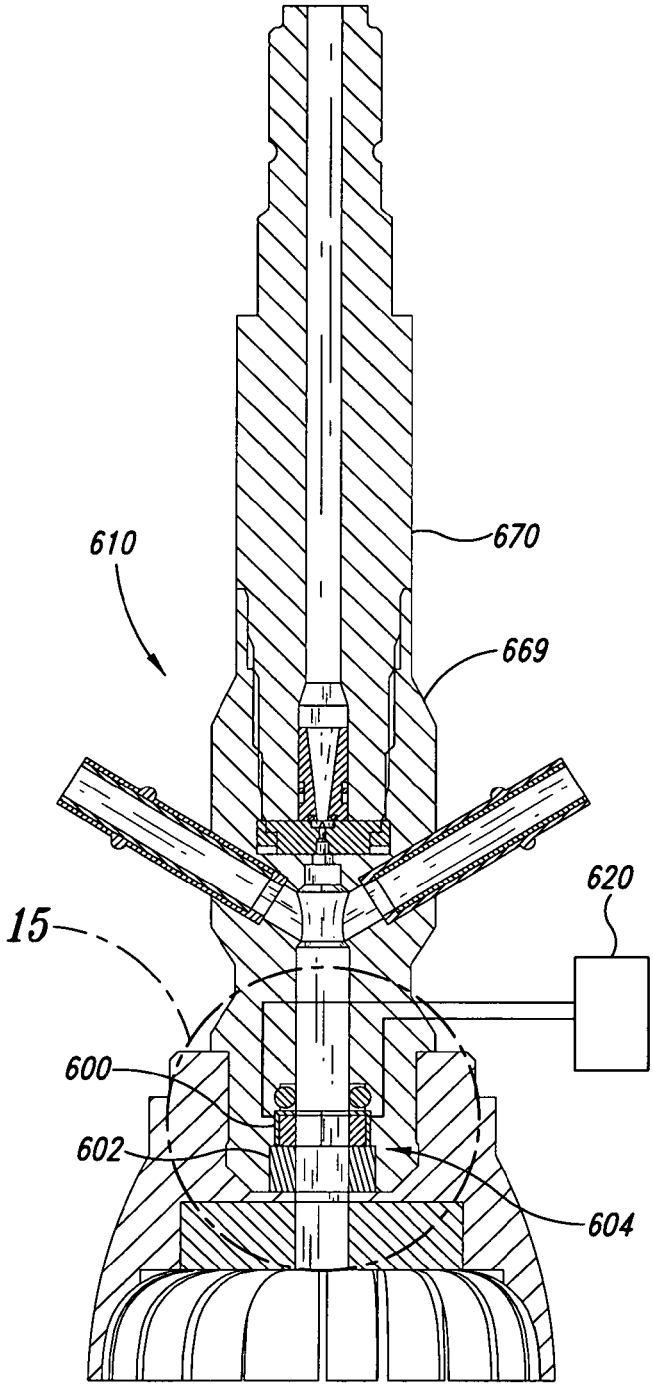
FIG. 14 is a cross-sectional view of a cutting head assembly and a control system for evaluating a position of a mixing tube of the cutting head assembly, in accordance with one illustrated embodiment.

The retainer 229 itself can function as a sensor. In some embodiments, including the illustrated embodiment of FIGS. 14 and 15, one or both couplers 600, 602 of a retainer 604 are in communication with a control system 620. The retainer 604 can have an open state for indicating that the mixing tube 225 is improperly positioned and a closed state indicating that mixing tube 225 is properly positioned. When the retainer 604 is in the closed state, the coupler 600 physically and electrically contacts the coupler 602 to complete a circuit to send a signal to the control system 620 indicating that the mixing tube 225 is in the proper position.

To send a signal, a current flows through a line 678 into a first conductive portion 680 of the coupler 600. If the couplers 600, 602 contact each other, the current flows from the first conductive portion 680 through the coupler 602, made of a conductive material, and into a second conductive portion 690 of the coupler 600. Line 681 connects the second conductive portion 690 of the coupler 600 to the control system 620. In this manner, a closed circuit is formed when the couplers 600, 602 contact one another.

If the couplers 600, 602 are spaced apart from one another (i.e., a gap is between the couplers 600, 602), the circuit is opened indicating unwanted separation, and the control system 620 can stop processing of the workpiece. An operator can then reposition the mixing tube such that processing can resume.

Figure 15:
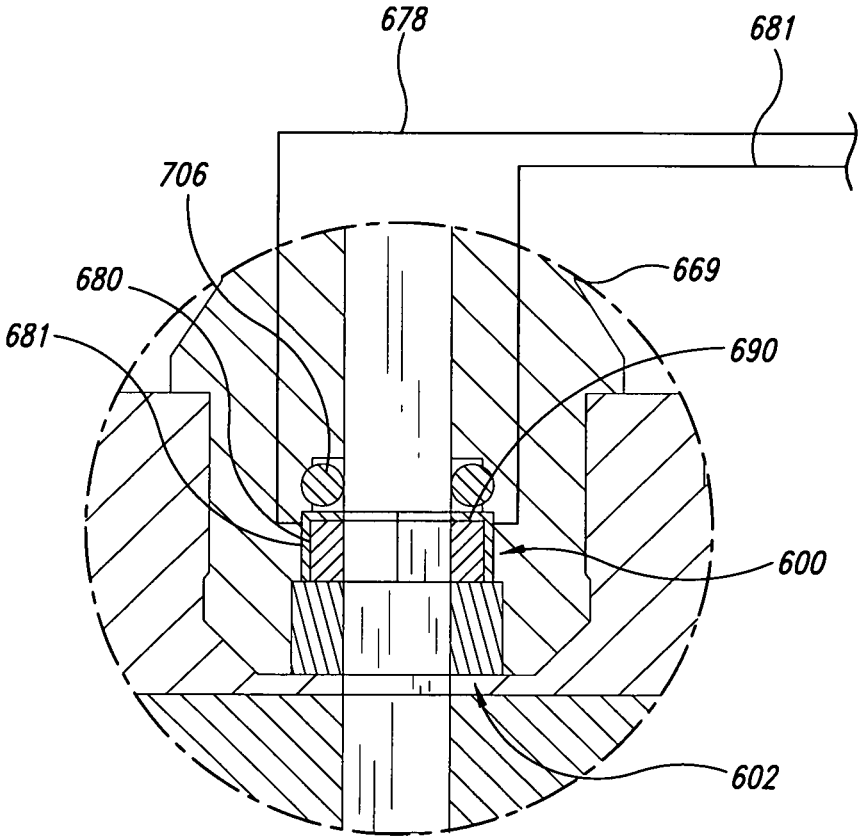
FIG. 15 is an enlarged view of a retainer of the cutting head assembly of FIG. 14.

The couplers 600, 602 can be insulated from the cutting head body to prevent shorting of the circuit. FIG. 15 shows the coupler 600 including an insulative portion 681 for insulating the first and second conductive portions 680, 690 from a cutting head body 669 and for insulating the first conductive portion 680 from the second conductive portion 690. The insulative portion 681 can be made of one or more electrically insulating materials, such as polymers, rubbers, ceramics, or the like. The first and second conductive portions 680, 690 can be made, in whole or in part, of one or more electrically conductive materials, such as aluminum, copper, and the like.

Figure 16:
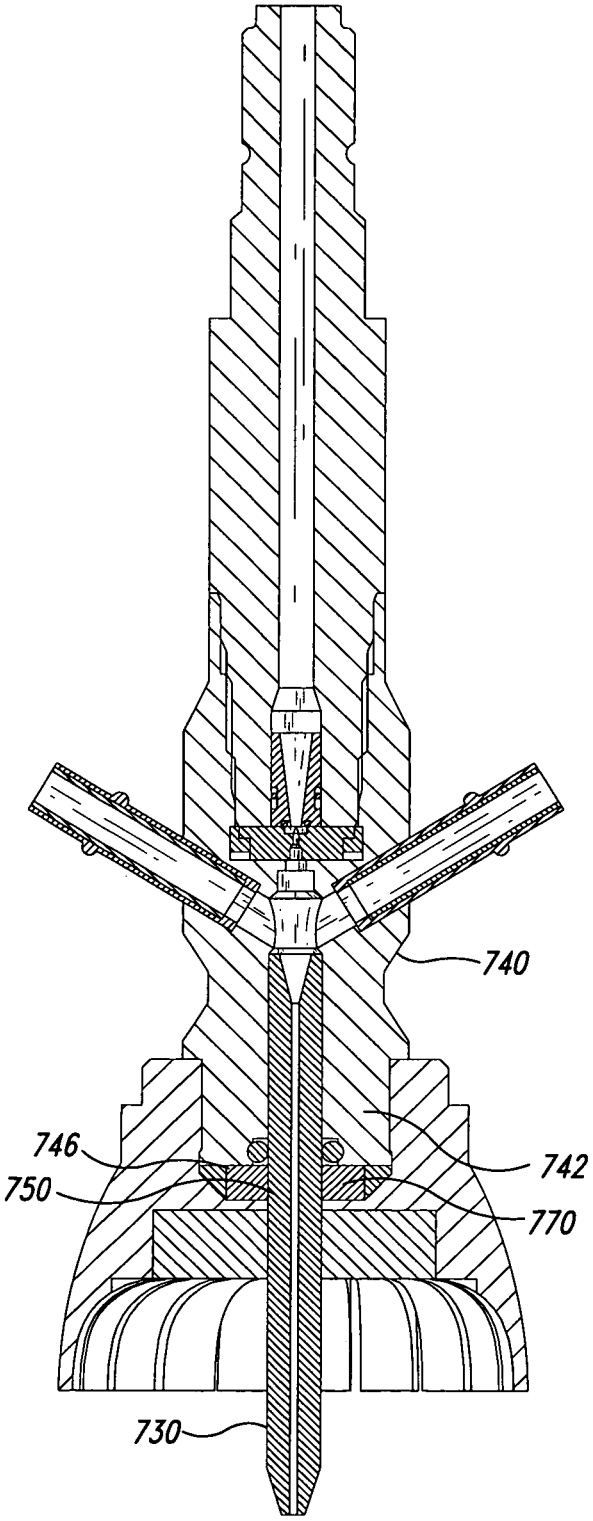
FIG. 16 is a cross-sectional view of a cutting head assembly, in accordance with one illustrated embodiment.

FIG. 16 shows a mixing tube 730 coupled to a cutting head body 740 having a first portion 742 that is made, in whole or in part, of a material (e.g., ferromagnetic material) attracted to magnets. A second portion 746 surrounds a coupler 750 of the mixing tube 730. The second portion 746 is an annular member that closely surrounds the coupler 750 and can be made, in whole or in part, of a non-ferromagnetic material (e.g., plastic) or other material not attracted to magnets. The coupler 750 (e.g., a permanent magnet or a electromagnet) can produce a magnetic field that attracts the coupler 750 to a lower surface 770 of the first portion 742.

In the illustrated embodiment of FIG. 16, the coupler 750 can be conveniently inserted and passed through the second portion 746 to magnetically couple the coupler 750 to the first portion 742. Magnetic forces bias the coupler 750 towards the first portion 742, even if the coupler 750 vibrates or moves away from the first portion 742 during operation, without interference from the second portion 746.

The second portion 746 in some embodiments may include one or more magnets to further reduce unwanted movement of the mixing tube 730. In some embodiments, magnetic material is applied to one or more sections of the second portion 746 to, for example, center the mixing tube 730 with respect to the cutting head body 740. Various magnetic fields can be generated to ensure that the mixing tube 730 is kept in a desired position. In some embodiments, the cutting head body 740 can have a one-piece construction. For example, the cutting head body 740 can be monolithically formed by a molding process, machining process, and the like, and can be made of a magnetic material, ferromagnetic material, or combinations thereof.

Various methods and techniques described above provide a number of ways to carry out the disclosed embodiments. Furthermore, the skilled artisan will recognize the interchangeability of various features, such as couplers and mixing tubes, from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction; and a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction, and wherein the cutting head body includes a cutting head body coupler that magnetically couples to the coupler of the mixing tube, and at least one of the cutting head body coupler and the coupler of the mixing tube is a magnet.

2. The abrasive waterjet assembly of claim 1, wherein the cutting head body further includes a port for entraining abrasives.

3. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction; and a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction, and wherein the cutting head body includes a first cylindrical magnet, the first cylindrical magnet surrounding the mixing tube and magnetically engaging the coupler of the mixing tube.

4. The abrasive waterjet assembly of claim 3, wherein the first cylindrical magnet includes at least one of a rust-resistant coating, and an impact resistant coating.

5. The abrasive waterjet assembly of claim 3, wherein the coupler of the mixing tube comprises a second cylindrical magnet positioned adjacent to the first cylindrical magnet.

6. The abrasive waterjet assembly of claim 3, wherein the coupler of the mixing tube comprises a ferromagnetic material that is not permanently magnetized.

7. The abrasive waterjet assembly of claim 6, wherein the coupler of the mixing tube comprises magnetic stainless steel.

8. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction; and a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction, and wherein the cutting head body comprises a ferromagnetic material that is not permanently magnetized, and wherein the coupler comprises a magnet capable of magnetically coupling to the ferromagnetic material of the cutting head body.

9. The abrasive waterjet assembly of claim 8, wherein the magnet is a permanent magnet or an electromagnet.

10. The abrasive waterjet assembly of claim 1, wherein the cutting head body coupler is an electromagnet, the electromagnet surrounding the mixing tube and, in an electrically charged state, magnetically engaging the coupler of the mixing tube.

11. The abrasive waterjet assembly of claim 10, wherein the electromagnet includes a rust-resistant coating.

12. The abrasive waterjet assembly of claim 10, wherein the coupler of the mixing tube comprises a permanent magnet that is adjacent to the electromagnet.

13. The abrasive waterjet assembly of claim 10, wherein the coupler of the mixing tube comprises a ferromagnetic material that is not permanently magnetized.

14. The abrasive waterjet assembly of claim 10, wherein the coupler of the mixing tube comprises magnetic stainless steel.

15. The abrasive waterjet assembly of claim 1, wherein the cutting head body further comprises a sealing member located within the mixing tube bore and compressed against the upstream portion of the mixing tube.

16. The abrasive waterjet assembly of claim 1, wherein the cutting head body further comprises a sealing member surrounding an exit of the mixing tube bore and compressed against the mixing tube.

17. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction; and a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction, and wherein the coupler of the mixing tube includes a rust-resistant coating.

18. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction; and a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction, and wherein the mixing tube further includes a communication device capable of communicating encoded information.

19. The abrasive waterjet assembly of claim 18, wherein the communication device includes at least one radio frequency identification tag having encoded information correlated with at least one physical characteristic of the mixing tube.

20. The abrasive waterjet assembly of claim 18, further comprising:

a detector for detecting information encoded in the communication device.

21. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction;

a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction; and a magnetic flux detector adapted and positioned to detect magnetic flux originating, at least in part, from the coupler of the mixing tube.

22. The abrasive waterjet assembly of claim 1, wherein the upstream portion of the mixing tube has a longitudinal length that is greater than or equal to two times an outer diameter of the upstream portion of the mixing tube.

23. A waterjet assembly of a waterjet system configured to discharge a high-pressure waterjet in a discharge direction, the waterjet assembly comprising:

a cutting head body having a central bore and a coupler receiving portion located at a downstream end of the cutting head body, the coupler receiving portion defining a coupler cavity open in the discharge direction; and a mixing tube including a first coupler adapted to magnetically couple the mixing tube to the cutting head body, the mixing tube and the first coupler detachable as a unit from the central bore and the coupler receiving portion of the cutting head body in the discharge direction, and wherein the first coupler extends outwardly from a tubular main body of the mixing tube, and at least a portion of the cutting head body and the mixing tube are capable of generating magnetic forces sufficient to keep the mixing tube coupled to the cutting head body as a fluid jet passes through the tubular main body of the mixing tube.

24. A waterjet assembly of a waterjet system configured to discharge a high-pressure waterjet in a discharge direction, the waterjet assembly comprising:

a cutting head body having a central bore and a coupler receiving portion located at a downstream end of the cutting head body, the coupler receiving portion defining a coupler cavity open in the discharge direction; and a mixing tube including a first coupler adapted to magnetically couple the mixing tube to the cutting head body, the mixing tube and the first coupler detachable as a unit from the central bore and the coupler receiving portion of the cutting head body in the discharge direction, and wherein the cutting head body includes a second coupler that magnetically couples to the first coupler.

25. The waterjet assembly of claim 24, wherein at least one of the first and second couplers is a magnet.

26. A waterjet assembly of a waterjet system configured to discharge a high-pressure waterjet in a discharge direction, the waterjet assembly comprising:

a cutting head body having a central bore and a coupler receiving portion located at a downstream end of the cutting head body, the coupler receiving portion defining a coupler cavity open in the discharge direction; and a mixing tube including a first coupler adapted to magnetically couple the mixing tube to the cutting head body, the mixing tube and the first coupler detachable as a unit from the central bore and the coupler receiving portion of the cutting head body in the discharge direction, and wherein the first coupler is an annular magnetic ring surrounding and physically coupled to an elongate main body of the mixing tube.

27. A waterjet assembly of a waterjet system configured to discharge a high-pressure waterjet in a discharge direction, the waterjet assembly comprising:

a cutting head body having a central bore and a coupler receiving portion located at a downstream end of the cutting head body, the coupler receiving portion defining a coupler cavity open in the discharge direction;

a mixing tube including a first coupler adapted to magnetically couple the mixing tube to the cutting head body, the mixing tube and the first coupler detachable as a unit from the central bore and the coupler receiving portion of the cutting head body in the discharge direction; and means for evaluating a position of the mixing tube with respect to the cutting head body.

28. The waterjet assembly of claim 27, wherein the means for evaluating includes a sensor having a closed state when the mixing tube is in a first position with respect to the cutting head body and an opened state when the mixing tube is in a second position with respect to the cutting head body.

29. A waterjet assembly of a waterjet system configured to discharge a high-pressure waterjet in a discharge direction, the waterjet assembly comprising:

a cutting head body having a central bore and a coupler receiving portion located at a downstream end of the cutting head body, the coupler receiving portion defining a coupler cavity open in the discharge direction;

a mixing tube including a first coupler adapted to magnetically couple the mixing tube to the cutting head body, the mixing tube and the first coupler detachable as a unit from the central bore and the coupler receiving portion of the cutting head body in the discharge direction; and a sensor adapted to output at least one signal based, at least in part, on contact between the mixing tube and the cutting head body.

30. A magnetic mixing tube cartridge for a waterjet assembly, the magnetic mixing tube cartridge consisting essentially of:

an elongate main body having an upstream portion defining an inlet, a downstream portion defining an outlet, and a fluid jet passageway extending between the inlet and the outlet; and a first coupler physically coupled to the main body between the upstream and downstream portions of the main body, the first coupler comprising a magnet for magnetically coupling the magnetic mixing tube cartridge to a cutting head body of a waterjet assembly when the upstream portion is within the cutting head body.

31. A method of assembling a waterjet assembly comprising a cutting head body and a mixing tube configured to discharge a waterjet in a discharge direction, the method comprising:

inserting an upstream portion of the mixing tube into a bore of the cutting head body in a direction opposite of the discharge direction; and magnetically engaging a magnetic coupler of the mixing tube with the cutting head body to couple the mixing tube to the cutting head body.

32. The method of claim 31, wherein the magnetic coupler of the mixing tube comprises a permanent magnet, and magnetically engaging the magnetic coupler of the mixing tube further comprises bringing the permanent magnet adjacent to the bore of the cutting head body.

33. The method of claim 31, wherein a portion of the cutting head body is surrounded by a permanent magnet of the cutting head body, and magnetically engaging the magnetic coupler of the mixing tube further comprises bringing the magnetic coupler of the mixing tube adjacent to the permanent magnet of the cutting head body.

34. The method of claim 31, wherein a portion of the cutting head body is defined by an electromagnet, and magnetically engaging the magnetic coupler of the mixing tube further comprises bringing the magnetic coupler of the mixing tube adjacent to the electromagnet and driving an electrical current through the electromagnet.

35. The method of claim 31, further comprising:

measuring magnetic flux originating at least in part from the magnetic coupler of the mixing tube to identify at least one characteristic of the mixing tube.

36. The method of claim 31, further comprising:

detecting a radio frequency signal emanating from the mixing tube, and processing the detected radio frequency signal to identify at least one characteristic of the mixing tube.

37. A waterjet assembly, comprising:

a cutting head body having a bore;

a mixing tube adapted for placement in the bore; and a sensor adapted to output a position signal based, at least in part, on a position of the mixing tube with respect to the cutting head body.

38. The waterjet assembly of claim 37, wherein the mixing tube includes a first coupler, the cutting head body includes a second coupler that magnetically couples to the first coupler, and the sensor comprises the first and second couplers and has an open state and a closed state, the first coupler spaced apart from the second coupler when the sensor is in the open state, the first coupler in physical contact with the second coupler when the sensor is in the closed state.

39. The waterjet assembly of claim 38, wherein the sensor is adapted to output the position signal in the closed state.

40. The waterjet assembly of claim 37, wherein the sensor is a proximity sensor capable of detecting the position of the mixing tube with respect to the cutting head body.

41. The waterjet assembly of claim 37, further comprising:

a control system adapted to receive the position signal output by the sensor and to adjust a fluid jet passing through the mixing tube based, at least in part, on the position signal.

42. The waterjet assembly of claim 37, further comprising:

a reader configured and positioned to receive an information signal from the sensor, the information signal indicative of one or more physical characteristics of the mixing tube.

43. The waterjet assembly of claim 42, wherein the sensor includes at least one radio frequency identification tag having encoded information that is correlated with the one or more physical characteristics of the mixing tube.

44. The waterjet assembly of claim 42, further comprising:

a control system in communication with the reader, the control system adapted to adjust a fluid jet passing through the mixing tube based, at least in part, on at least one of the position signal and the information signal from the sensor received by the reader.

45. The waterjet assembly of claim 37, wherein the mixing tube includes a coupler adapted to magnetically couple the mixing tube to the cutting head body.

46. An abrasive waterjet assembly of a waterjet system configured to discharge a high-pressure abrasive waterjet in a discharge direction, the abrasive waterjet assembly comprising:

a cutting head body having a mixing tube bore and a coupler receiving portion, the coupler receiving portion defining a cavity open in the discharge direction; and a mixing tube having an upstream portion disposed within the mixing tube bore and a coupler extending radially beyond an outer diameter of at least a portion of the upstream portion, the coupler disposed in the coupler receiving portion of the cutting head body and magnetically engaging the cutting head body, the mixing tube and the coupler detachable as a unit from the cutting head body in the discharge direction, and wherein the mixing tube and coupler are configured to detach from the cutting head body in the discharge direction when a force is applied in the discharge direction sufficient to overcome a threshold magnetic force acting on the coupler, the threshold magnetic force being of a magnitude sufficient to retain the mixing tube within the cutting head body during a cutting operation against a shear force acting in the discharge direction arising from the high-pressure abrasive jet passing through the mixing tube.

* * * * *